US007262391B2

(12) United States Patent
Nishihara et al.

(10) Patent No.: US 7,262,391 B2
(45) Date of Patent: Aug. 28, 2007

(54) IMAGE HEATING APPARATUS HAVING A HEAT GENERATION MEMBER GENERATING HEAT BY MAGNETIC FLUX AND HEATING AN IMAGE ON A RECORDING MATERIAL

(75) Inventors: Hiroto Nishihara, Toride (JP); Manabu Yamauchi, Kashiwa (JP); Kenji Fukushi, Toride (JP); Yasuyuki Aiko, Toride (JP); Hidehiko Kinoshita, Kashiwa (JP); Tomoichiro Ohta, Kashiwa (JP); Takamitsu Hirayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/348,356

(22) Filed: Feb. 7, 2006

(65) Prior Publication Data

US 2006/0157475 A1 Jul. 20, 2006

Related U.S. Application Data

(62) Division of application No. 11/078,372, filed on Mar. 14, 2005, now Pat. No. 7,030,345.

(30) Foreign Application Priority Data

Mar. 16, 2004 (JP) ..... 2004-074042

(51) Int. Cl.
*H05B 6/14* (2006.01)
*G03G 15/20* (2006.01)

(52) U.S. Cl. ..... 219/619; 219/649; 219/667; 399/328; 399/330

(58) Field of Classification Search ..... 219/619, 219/647, 649, 652, 661–668; 399/328–338
See application file for complete search history.

(56) References Cited

U.S. PATENT DOCUMENTS

| | | | | |
|---|---|---|---|---|
| 5,942,882 | A | 8/1999 | Ohta | 323/282 |
| 6,188,054 | B1 | 2/2001 | Ohta | 219/663 |
| 6,330,422 | B1 | 12/2001 | Sato et al. | 399/382 |
| 6,603,951 | B2 | 8/2003 | Sato et al. | 399/382 |
| 6,640,064 | B2 | 10/2003 | Kinoshita | 399/69 |
| 6,651,980 | B2 | 11/2003 | Isemura et al. | 271/259 |
| 6,691,399 | B1 | 2/2004 | Hayashi et al. | 29/605 |
| 6,782,236 | B2 | 8/2004 | Sasaki et al. | 399/401 |
| 6,804,474 | B2 | 10/2004 | Morita et al. | 399/23 |

(Continued)

FOREIGN PATENT DOCUMENTS

| | | |
|---|---|---|
| JP | 59-33787 | 2/1984 |

(Continued)

*Primary Examiner*—Philip H. Leung
(74) *Attorney, Agent, or Firm*—Fitzpatrick, Cella, Harper & Scinto

(57) ABSTRACT

A heating apparatus, for heating a material P to be heated by heat from a heat generation member which has a predetermined curie temperature characteristic and generates heat by magnetic flux produced by a magnetic flux generation device. The apparatus includes a discrimination device for discriminating whether or not the curie temperature characteristic of the heat generation member is a predetermined characteristic and a control device for terminating the supply of electric power to the magnetic flux generation device when the discrimination device determines that the curie temperature characteristic is not the predetermined characteristic.

6 Claims, 8 Drawing Sheets

U.S. PATENT DOCUMENTS

| | | | | |
|---|---|---|---|---|
| 6,842,592 | B2 | 1/2005 | Kinoshita | 399/69 |
| 7,030,345 | B2 * | 4/2006 | Nishihara et al. | 219/619 |
| 2004/0007569 | A1 | 1/2004 | Ohta | 219/624 |
| 2004/0037580 | A1 | 2/2004 | Ohta | 399/69 |

FOREIGN PATENT DOCUMENTS

| | | |
|---|---|---|
| JP | 2-163786 | 6/1990 |
| JP | 5-66693 | 3/1993 |
| JP | 5-333655 | 12/1993 |
| JP | 8-286542 | 11/1996 |
| JP | 10-10497 | 1/1998 |
| JP | 11-190950 | 7/1999 |
| JP | 2000-39797 | 2/2000 |

* cited by examiner

IMAGE HEATING APPARATUS HAVING A HEAT GENERATION MEMBER GENERATING HEAT BY MAGNETIC FLUX AND HEATING AN IMAGE ON A RECORDING MATERIAL

This application is a divisional of U.S. patent application Ser. No. 11/078,372, filed Mar. 14, 2005, and allowed Jan. 6, 2006 now U.S. Pat. No. 7,030,345.

FIELD OF THE INVENTION AND RELATED ART

The present invention relates to an image heating apparatus, including a heat generation member which has a predetermined curie temperature characteristic and generates heat by magnetic flux produced by a magnetic flux generation means, for heating an image on a recording material by heat generation of the heat generation member. Particularly, the present invention relates to an image heating apparatus suitable for a fixing apparatus for fixing the image on the recording material.

A copying machine of an electrophotographic-type or the like is provided with a fixing apparatus for fixing a toner image formed on a sheet, such as recording paper or a transfer (-receiving) material, as a recording medium through a transfer scheme or a direct scheme, on the sheet.

The fixing apparatus includes, e.g., a fixation roller, which is also called a heating roller for heat-melting toner on the sheet, and a pressure roller which is pressed against the fixation roller to sandwich the sheet therebetween. The fixation roller is formed in a hollow shape and on a center axis of the fixation roller, a heat generation member is held by a holding means. The heat generation member is, e.g., constituted by a tube-like heat generation heater, such as a halogen lamp, and generates heat by applying a predetermined voltage thereto. The halogen lamp is located on the fixation roller center axis, so that the temperature distribution at an outer wall of the fixation roller is uniform in a circumferential direction. The outer wall of the fixation roller is heated until a temperature thereof reaches a suitable fixing temperature (e.g., 150-200° C.). In such a state, the fixation roller and the pressure roller are rotated in mutually opposite directions while contacting each other under pressure, whereby the sheet to which the toner is attached is conveyed while being sandwiched therebetween. At a pressing portion (nip portion) between the fixation roller and the pressure roller, the toner on the sheet is melted by heat of the fixation roller to be fixed on the sheet under the application of pressure from the both rollers.

However, in the above described fixing apparatus provided with the heat generation member constituted by the halogen lamp or the like, the fixation roller is heated by utilizing radiant heat from the halogen lamp, so that a time from power-up to reaching of the fixation roller temperature of a predetermined temperature suitable for fixation (hereinafter referred to as "warm-up time") has becomes relatively long. During the warm-up time, a user cannot use the copying machine, so that there arises such a problem that the user is forcedly caused to wait a long time. On the other hand, when a large amount of electric power is supplied to the fixation roller in order to reduce the warm-up time to improve operability for the user, power consumption in the fixing apparatus is increased, thus resulting in such a problem that the increased power consumption is contradictory to energy saving. For this reason, in order to enhance the commercial value of the copying machine, attention and importance have been put on the realization of energy saving (low power consumption) of the fixing apparatus and improvement in user operability (quick print performance) in combination.

As satisfying a heating apparatus satisfying such requirements, Japanese Laid-Open Patent Application (JP-A) No. Sho 59-33787 has proposed an induction heating type fixing apparatus which utilizes high-frequency induction heating as a heat source. In the fixing apparatus of this type, a coil is disposed concentrically in hollow fixation roller comprising a metal conductor. A high-frequency current is passed through the coil to generate a high-frequency magnetic field. The magnetic field generates an induction eddy current, whereby the fixing apparatus itself generates Joule heat due to its own skin resistance. According to the induction heating-type fixing apparatus, electricity-heat conversion efficiency is significantly improved, so that it becomes possible to reduce the warm-up time.

However, such an induction heating-type fixing apparatus is actuated so that the entire area of a maximum-sized recording material capable of being passed therethrough is heated at a fixing temperature to perform fixation. For this reason, energy higher than that required for actual toner fixation has been consumed. Further, with respect to a recording material of some sizes, an area other than the sheet-passing area has been abnormally heated to cause the inside temperature rise or heat deterioration of a non-heating member.

In order to solve such problems, JP-A No. 2000-39797 has proposed a fixation roller having a Curie temperature (Curie point) close to a fixing temperature. By using this fixation roller, the temperature rise is alleviated at a temperature not less than a permeability change point which is a characteristic feature of the Curie temperature, so that it becomes possible to prevent an excessive temperature rise at the non-sheet passing area or of the non-heating member.

Further, in JP-A No. Hei 11-190950, a fixing control temperature is set to be not more than a Curie temperature. In JP-A No. Hei 10-10497, a judgement as to whether a temperature reaches a Curie temperature or not is made and when the temperature reaches the Curie temperature, the sheet feeding interval is changed.

However, with respect to the fixation roller having a Curie temperature (Curie temperature roller), there is a possibility that the actual Curie temperature of fixation roller in its production process varies with respect to a set Curie temperature. For this reason, at the time of assembly of the fixing apparatus or replacement of the fixation roller, the actual Curie temperature can be less than a temperature tolerance acceptable range with respect to the set Curie temperature, so that there is a possibility that a fixation roller having a Curie temperature lower than an ordinary (fixing) control temperature is used. In this case, a desired fixability cannot be satisfied. On the other hand, the actual Curie temperature can be more than the temperature tolerance acceptable range with respect to the set Curie temperature, so that there is also be possibility that a fixation roller having a Curie temperature higher than a heat-resistance temperature of peripheral parts is used. In the case where the fixation roller temperature cannot be controlled, when the temperature is continuously increased over the ordinary control temperature, there is a possibility that the peripheral parts of the fixation roller go out of order, produce smoke, or catch fire.

Further, such a Curie temperature roller is changed in Curie temperature due to continuous use or deterioration in some cases. In such cases, the above described problems can arise depending on the degree of the change in Curie temperature.

SUMMARY OF THE INVENTION

A principal object of the present invention is to prevent the occurrences of the above described problems due to the deviation of a predetermined curie temperature characteristic, of a heat generation member for generating heat by magnetic flux generated by a magnetic flux generation means, from an acceptable range of a described curie temperature characteristic.

An object of the present invention is to provide a fixing apparatus having solved the above described problems.

According to as aspect of the present invention, there is provided an image heating apparatus comprising:

magnetic flux generation means for generating magnetic flux by energization;

a heat generation member which generates heat by magnetic flux generated by the magnetic flux generation means and heats an image on a recording material, detection means for detecting a curie temperature characteristic of the heat generation member;

discrimination means for discriminating whether or not the curie temperature characteristic of the heat generation member is a predetermined characteristic, on the basis of a detection result of the detection means; and control means for controlling whether or not energization of the magnetic flux generation means is prohibited, on the basis of a discrimination result of the discrimination means.

According to another aspect of the present invention, there is provided an image heating apparatus, comprising:

magnetic flux generation means for generating magnetic flux by energization;

a heat generation member which generates heat by magnetic flux generated by the magnetic flux generation means and heats an image on a recording material, detection means for detecting a curie temperature characteristic of the heat generation member; and discrimination means for discriminating whether or not the curie temperature characteristic of the heat generation member is a predetermined characteristic, on the basis of a detection result of the detection means;

wherein a warning is produced on the basis of a detection result of the detection means.

these and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(1) Embodiment of Image Forming Apparatus

Figure 1:
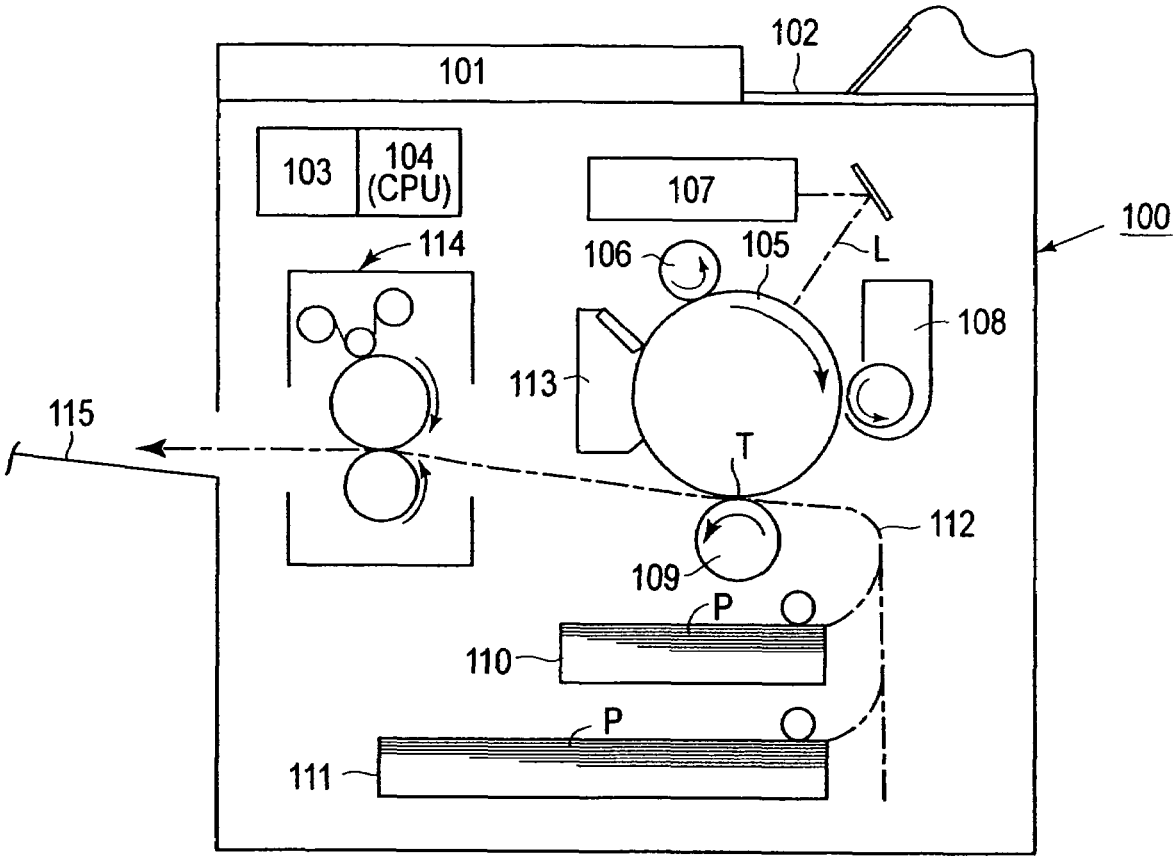
FIG. 1 is a schematic structural view of an embodiment of an image forming apparatus in Embodiment 1.

FIG. 1 is a schematic structural view of an embodiment of an image forming apparatus according to the present invention.

In this embodiment, an image forming apparatus 100 is a laser scanning exposure-type digital image forming apparatus (a copying machine, a printer, a facsimile machine, a multi-functional machine of these machines, etc.) which utilizes a transfer-type electrophotographic process and is provided with an induction heating-type fixing apparatus.

On an upper surface side of the image forming apparatus 100, an original reading apparatus (image scanner) 101 and an area designating apparatus (digitizer) 102 are disposed. The original reading apparatus 101 scans a surface of an original placed on a original supporting plate of the apparatus with a scanning illumination optical system including a light source and others disposed inside the apparatus, and reads reflected light from the original surface with a photosensor, such as a CCD line sensor, to convert image information into a time-series electric digital pixel signal. The area designating apparatus 102 effects setting of, e.g., a reading area of the original to output a signal. A printer controller 103 outputs a print signal based on image data of an unshown personal computer etc. A controller (CPU, control means, (Curie temperature predetermined means) 104 receives the signals from the original reading apparatus 101, the area designating apparatus 102, the printer controller 103, etc., and executes signal processing for sending directions to respective portions of an image output mechanism and various image forming sequence controls.

In the image output mechanism, a rotary drum-type electrophotographic photosensitive member (hereinafter referred to as a "photosensitive drum") 105 as an image bearing member is rotationally driven in a clockwise direction of an indicated arrow at a predetermined peripheral speed. During the rotation, the photosensitive drum 105 is uniformly charged electrically to a predetermined polarity and a predetermined potential by a charging apparatus 106. The uniformly charged surface of the photosensitive drum 105 is exposed imagewise to light L by an image writing apparatus 107 to be reduced in potential at an exposure light part, whereby an electrostatic latent image corresponding to an exposure pattern is formed on the surface of the photosensitive drum 105. The image writing apparatus 107 used in this embodiment is a laser scanner and outputs laser light L modulated according to image data signal-processed in the controller (CPU) 104 to scan, for exposure, the uniformly charged surface of the rotating photosensitive drum 105, thus forming an electrostatic latent image corresponding to the original image information.

Next, the electrostatic latent image is developed as a toner image with toner by a developing apparatus. The toner image is electrostatically transferred from the surface of the photosensitive drum 105 onto a recording material (transfer material) P, as a recording medium, which has been supplied to a transfer portion T, of a transfer charging apparatus 109, opposite to the photosensitive drum 105 from a sheet (recording material) supply mechanism portion at a predetermined timing.

The sheet supply mechanism portion of the image forming apparatus of this embodiment includes a first sheet supply cassette portion 110 accommodating a small-sized recording material, a second sheet supply cassette portion 111 accommodating a large-sized recording material, and a recording material conveying path 112 for conveying the recording material P which has been selectively fed from the first or second sheet supply cassette portion on a one sheet basis to the transfer portion T at a predetermined timing.

The recording material P onto which the toner image has been transferred from the photosensitive drum 105 surface at the transfer portion is separated from the photosensitive drum 105 surface and conveyed to a fixing apparatus 114 by which an unfixed toner image is fixed on the recording material P, which is then discharged on an output tray 115 located outside the image forming apparatus.

On the other hand, the surface of the photosensitive drum 105 after the separation of the recording material P is cleaned by a cleaning apparatus 113 so as to remove residual toner remaining on the photosensitive drum 105. The photosensitive drum 105 is then repetitively subjected to image formation.

(2) Fixing Apparatus 114

Figure 2:
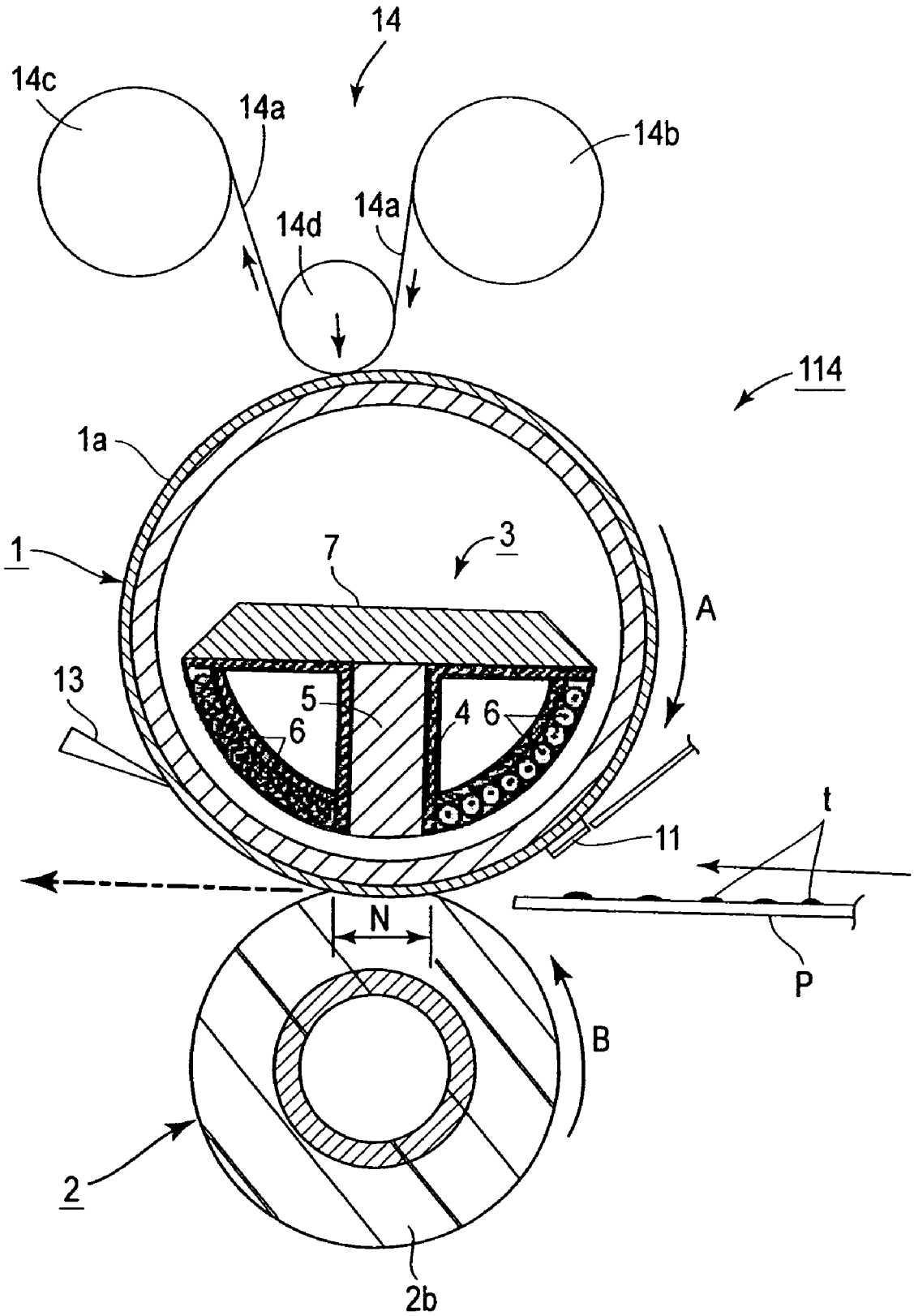
FIG. 2 is an enlarged cross-sectional view of a fixing apparatus.

FIG. 2 is an enlarged cross-sectional view of a principal portion of the fixing apparatus 114 as an image heating apparatus according to the present invention.

This fixing apparatus 114 is of a heating roller type and is a heating apparatus of an induction heating type. The fixing apparatus 114 principally includes a pair of a heating roller 1 (as a heating member (medium) or a fixing member) and a pressure roller 2 (as a pressure member) which are vertically disposed in parallel and pressed against each other at a predetermined pressing force to create a fixation nip portion N having a predetermined nip length (nip width).

The heating roller as a heat generation member (hereinafter referred to as a "fixation roller") 1 is a roller having a hollow (cylindrical) metallic layer (electroconductive layer or core metal) which is formed with an induction heating element (electromagnetic member), such as nickel or SUS 430 in a thickness of about 0.1-1.5 mm and having a desired curie temperature characteristic. At an outer peripheral surface of the roller, a heat-resistant release layer (heat conduction material) la is formed by coating the roller with a fluorine-containing resin etc.

In this embodiment, the fixing apparatus 114 has a fixation (fixing) temperature 230° C. and the fixation roller 1 is a fixation roller having such a curie temperature characteristic that a Curie temperature thereof is set to a temperature substantially identical to the fixation temperature thereof.

Here, the curie temperature characteristic is such a characteristic that the heat generation efficiency is lowered when the temperature of the heat generation member reaches a temperature identical or close to the Curie temperature. In the present invention, by utilizing this curie temperature characteristic, the heating (fixing) roller is controlled to effect image heating.

Figure 3:
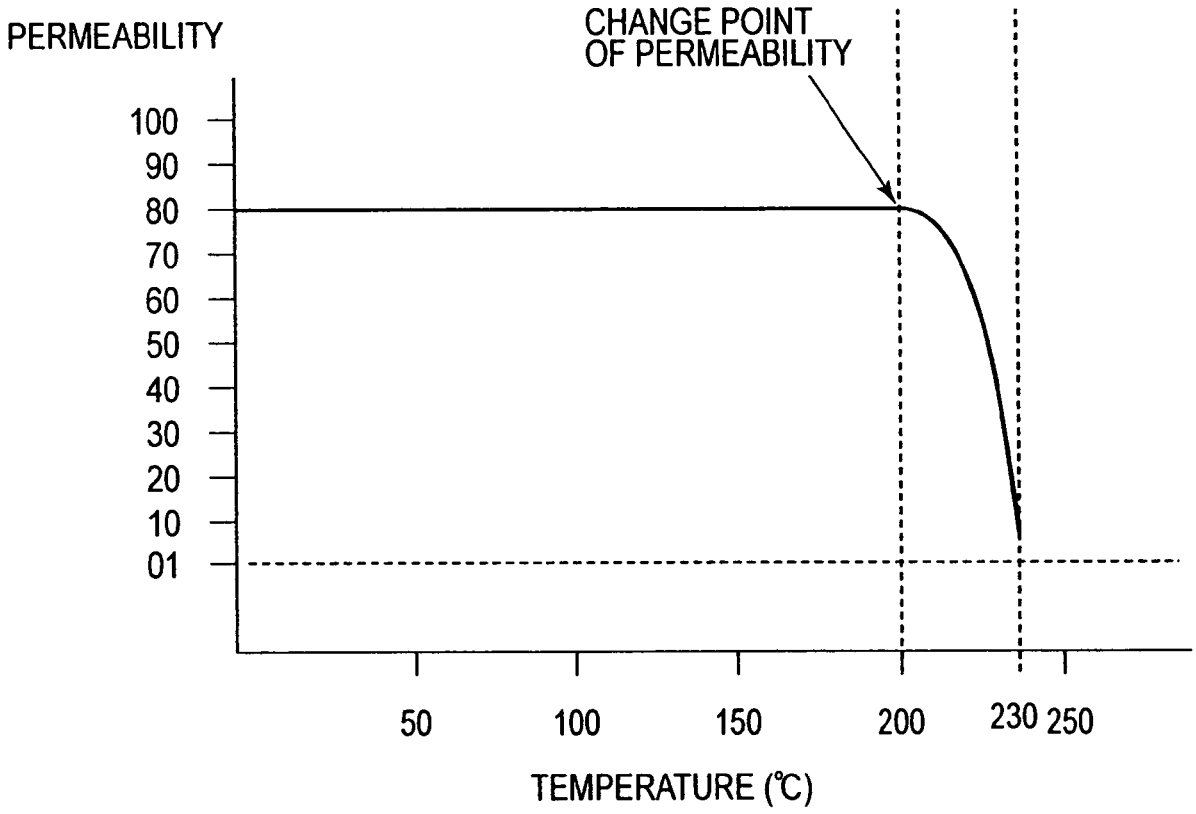
FIG. 3 is a graph for illustrating a change in permeability with a temperature of a metal layer (heat generation member) of a fixation roller.

More specifically, the metallic layer as an induction heating element of the fixation roller 1 in this embodiment has, as shown in FIG. 3, a changing point (temperature) in permeability of 200° C. and is a magnetism-adjusted alloy having a permeability of 1 at 230° C. The temperature at which the permeability reaches 1 is the so-called Curie temperature at which the induction heating element loses magnetism. Examples of the magnetism-adjusted alloy may include iron-nickel alloy adjusted to have a desired Curie temperature as disclosed in JP-A No. 2000-39797.

The fixation roller 1 is rotatably supported between side plates, located on the front and rear sides of the fixing apparatus, each via a bearing at both end portions thereof. Further, at an inner hollow portion of the fixation roller 1, a coil assembly 3, as a magnetic flux generation means, which generates a high-frequency field by inducing an induced current (eddy current) in the fixation roller 1 to cause Joule heat, is injected and disposed.

The pressure roller 2 is an elastic roller including a core shaft 2*a,* and a silicone rubber layer 2*b,* as a heat-resistant rubber layer with a surface releasability, which is integrally and concentrically wound around the core shaft 2*a.* The pressure roller 2 is disposed under and in parallel with the fixation roller 1 and is rotatably held between the side plates, located on the front and near sides of the fixing apparatus, each via a bearing at both end portions thereof. The pressure roller 2 is further pressed against the lower surface of the fixation roller 1 by an unshown urging means while resisting an elasticity of the elastic layer 2*b,* thus forming the fixation nip portion N having the predetermined nip length.

The coil assembly 3, as the magnetic flux generation means, inserted into the inner hollow portion of the fixation roller 1 is an assembly of a bobbin 4, a core (material) 5 comprising a magnetic material, an induction coil (exciting coil or induction heat source) 6, and a stay 7 formed with an insulating member. The core 5 is inserted into a through hole provided in the bobbin 4, and the induction coil 6 is constituted by winding a copper wire around the periphery of the bobbin. A unit of the bobbin 4, the core 5, and the induction coil 6 is fixedly supported by the stay 7.

The above described coil assembly 3 is inserted into the inner hollow portion of the fixation roller 1 to be placed in a position with a predetermined angle and in such a state that it holds a certain gap between the fixation roller 1 and the induction coil 6, so that the stay 7 is fixedly supported in a non-rotation manner by holding members (not shown) at both end portions thereof which are located on the front and rear sides of the fixing apparatus. The unit of the bobbin 4, the core 5, and the induction coil 6 is accommodated in the fixation roller 1 so as not to be protruded from the fixation roller 1.

As the core 5, a material which has a high permeability and small self-field loss may preferably be used. Examples thereof may suitably include ferrite, permalloy, sendust, etc. The bobbin 4 also functions as an insulating portion for insulating the core 5 from the induction coil 6.

On an outer peripheral surface of the fixation roller 1, a central temperature detection apparatus 11 for detecting the temperature of the fixation roller 1 is disposed. This central temperature detection apparatus 11 is pressed against the surface of the fixation roller 1 so that it and the induction coil 6 face each other through the fixation roller 1. The central temperature detection apparatus 11 may, e.g., be constituted by a thermistor.

A separation claw 13 functions as a means for separating the recording material P from the fixation roller 1 by suppressing winding of the recording material P, which is introduced into and passed through the fixing nip portion N, around the fixation roller 1.

The above described bobbin 4, the stay 7, and the separation claw 14 are formed of heat-resistant and electrically insulating engineering plastics.

A fixation roller cleaner 14 includes a cleaning web 41*a* as a cleaning member, a web feeding axis portion 14*b* which holds the cleaning web 14*a* in a roll shape, a web take-up axis portion 14*c*, and a pressing roller 14*d* for pressing the web portion between the both axis portions 14*b* and 14*c* against the outer surface of the fixation roller 1. By the web portion pressed against the fixation roller 1 by use of the pressing roller 14*d*, offset toner on the fixation roller 1 surface is wiped out to clean the fixation roller 1 surface. The web portion pressed against the fixation roller 1 is gradually renewed by feeding the web 14*a* little by little from the feeding portion 14*b* to the take-up portion 14*c*.

In this embodiment, sheet passing (feeding) is performed on the basis of a center line. In other words, all the recording materials of any sizes pass through the fixation roller in such a state that the center portion of the recording materials passes along the center portion in the roller axis direction of the fixation roller.

The controller 104 of the image forming apparatus starts a predetermined image forming sequence control by actuating the apparatus through power-on of a main switch ("SW" shown in FIG. 4) of the apparatus. The controller 104 may be provided to the fixing apparatus 114, and rotationally drive the fixation roller 1 in a clockwise direction indicated by an arrow A in FIG. 2 at a predetermined control timing by the drive source M. By the rotation of the fixation roller 1, the pressure roller 2 is also rotated in a counterclockwise direction indicated by an arrow B. Further, energization of a high-frequency current of a predetermined fixed value from the exciting circuit 116 to the induction coil 6 of the coil assembly 3 is started at a predetermined timing, whereby a high-frequency alternating magnetic field is generated in the neighborhood of the induction coil 6 and the temperature of the fixation roller 1 is increased due to the electromagnetic induction heating of the fixation roller 1. The temperature of the fixation roller 1 rises quickly and is converged at the Curie temperature, where the permeability of the fixation roller 1 becomes 1, via the change point temperature of the permeability. Thereafter, the temperature of the fixation roller 1 is substantially kept in a heating state at the Curie temperature so long as the above described high-frequency current energization to the induction coil 6 is continued (i.e., placed in a self-temperature controlled state).

The fixing apparatus 114 in this embodiment has the fixation temperature of 230° C. and the fixation roller 1 is the fixation roller having such a curie temperature characteristic that the Curie temperature thereof is substantially set to the fixation temperature as described above, so that the heating temperature of the fixation roller 1 is substantially converged at 230° C. (fixation temperature) and the fixation roller 1 is placed in the self-temperature controlled state. This temperature change with time of the fixation roller 1 is detected by the thermistor 11, and detected temperature information is inputted into the controller 104. The controller 104 detects that the temperature of the fixation roller 1 converges substantially at the Curie temperature. Then, in the temperature-controlled state of the fixation roller 1, the recording material P, as a material to be heated, carrying thereon an unfixed toner image t is introduced from the image formation side into the fixing nip portion N. The recording material P is sandwiched and conveyed between the fixation roller 1 and the pressure roller 2 in the nip portion N, whereby the unfixed toner image t is heat-fixed on the surface of the recording material P under heat and pressure by the fixation roller 1 and the pressing force at the nip portion N.

(3) Curie Temperature Measuring Mode

In order to prevent irregularity in the Curie temperature of the fixation roller 1 during the production thereof and the occurrences of the above described problems due to the deviation of the Curie temperature from the temperature tolerance acceptable range attributable to continuous use and deterioration of the fixation roller, the image forming apparatus in this embodiment is provided with a Curie temperature measuring mode described hereinbelow.

The Curie temperature measuring mode in this embodiment is such a control mode that an actual Curie temperature of the fixation roller 1 having the curie temperature characteristic mounted in the fixing apparatus is measured and judged whether or not the measured (actual) Curie temperature is in the temperature tolerance acceptable range with respect to a set Curie temperature and on the basis as to whether an image forming operation of the image forming apparatus should be performed or not.

Figure 5:
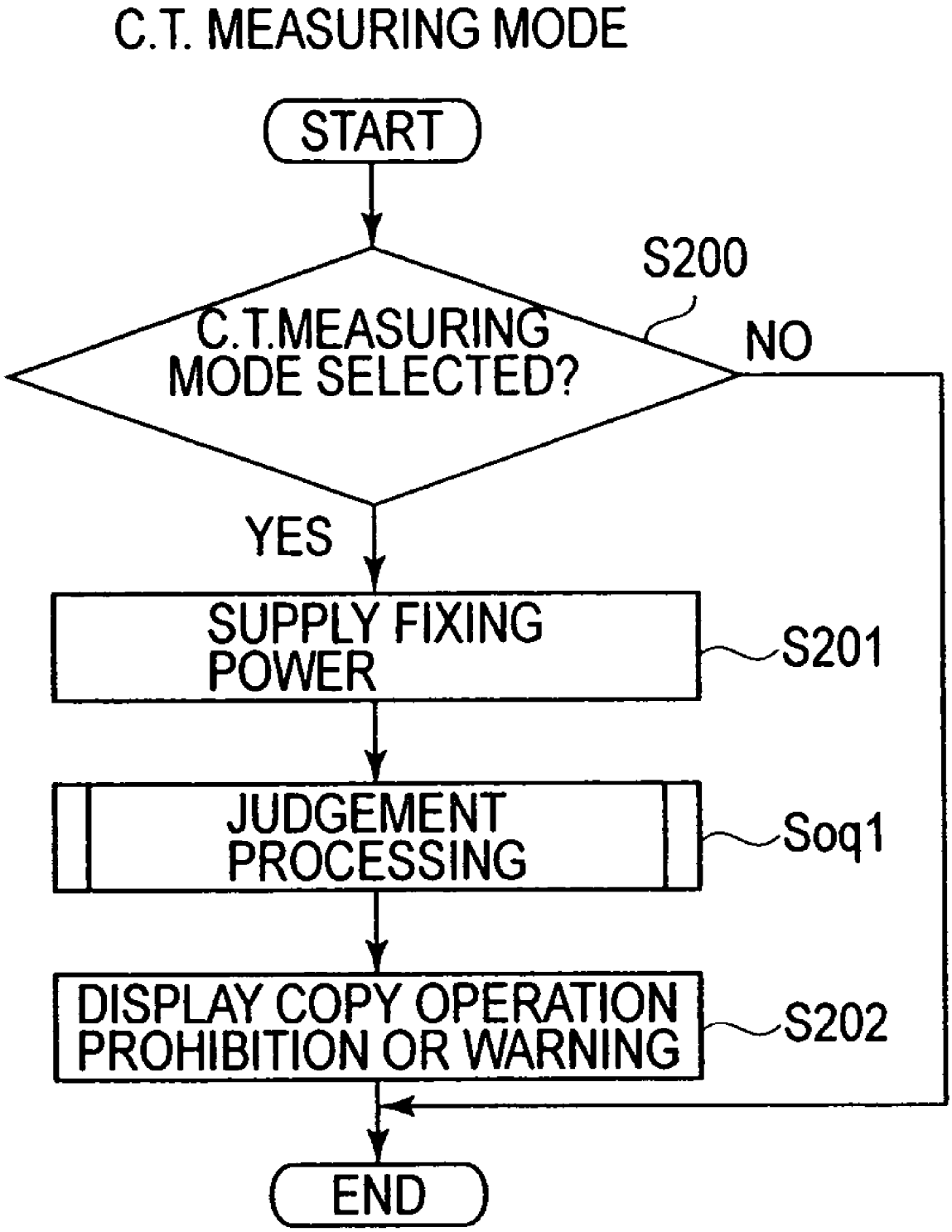
FIG. 5 is a basis flow chart of a Curie temperature measuring mode.
Figure 6:
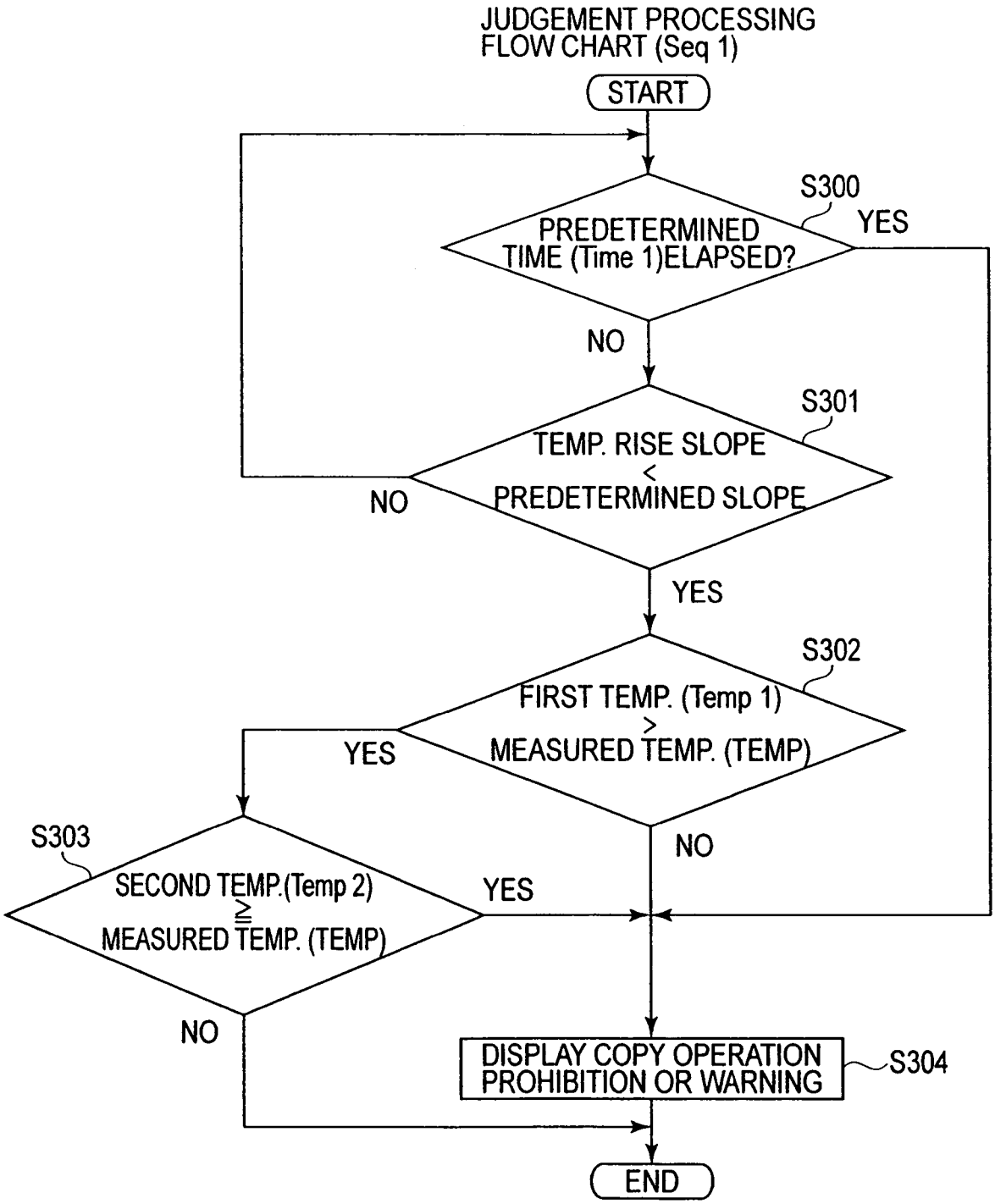
FIG. 6 is a flow chart showing a Curie temperature judgement processing in the Curie temperature measuring mode.
Figure 7:
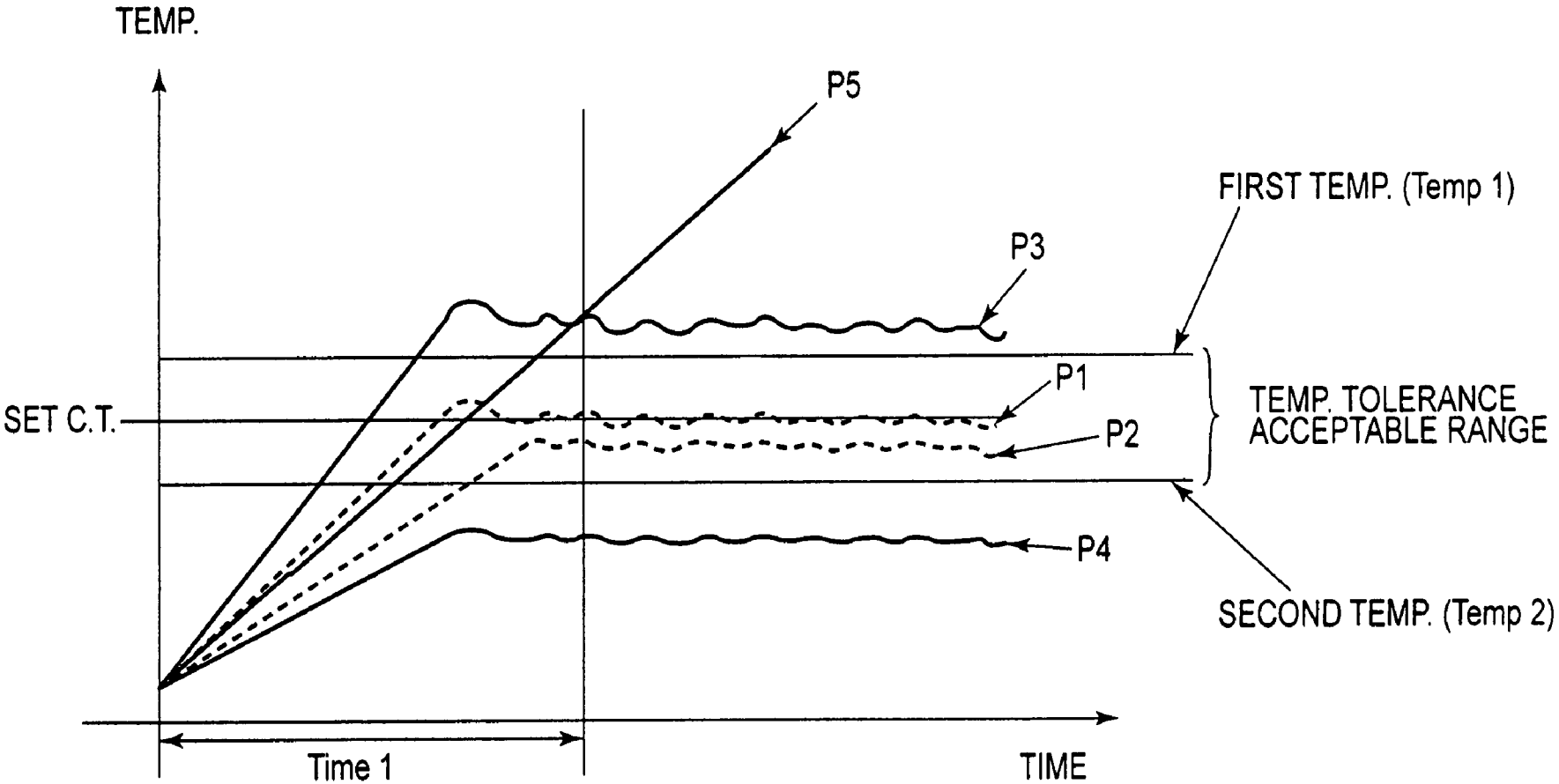
FIG. 7 is a time-series chart showing a temperature rise of the fixation roller in the Curie temperature measuring mode.

FIG. 5 is a basic flow chart of the Curie temperature measuring mode, and FIG. 6 is a flow chart showing a Curie temperature judgment processing in the Curie temperature measuring mode. Further, FIG. 7 is a time-series graph showing a temperature rise of the fixation roller 1 with time in the Curie temperature measuring mode.

The Curie temperature measuring mode in this embodiment is executed when this mode is selected by a mode selection switch 117 (shown in FIG. 4) provided at an operation portion of the image forming apparatus. The Curie temperature measuring mode may be executed on an anytime basis, more specifically, at any of the times of factory shipment of the image forming apparatus, setting thereof, replacement of the fixing member, power-on of the image forming apparatus (or the fixing apparatus), return to a stand-by state, and a lapse of predetermined time.

As shown in the basic flow chart of the Curie temperature measuring mode, in a step S201, the control portion 104 judges whether or not the Curie temperature measuring mode is selected by the mode selection switch 117 as a selection means. Instead of the mode selection switch, e.g., it is also possible to provide separately a storage (memory) means for storing information as to whether the Curie temperature measuring mode is selected or not and on the basis of the information stored in the storage means, to judge whether or not the Curie temperature measuring mode is selected. The information of the storage means is held even when the power of the image forming apparatus is turned off. When the Curie temperature measuring mode is not selected, the sequence is completed as it is without being executed. Incidentally, the selection as to whether or not the Curie temperature measuring mode should be executed can also be made by a signal from external equipment connected to the image forming apparatus.

In the case where the Curie temperature measuring mode is selected, the control portion 104 starts to supply electric power to the fixing apparatus 114 (S201). More specifically, similarly as at the time of performing the ordinary image forming operation, the fixation roller 1 is rotationally driven and energization of the fixing apparatus 114 by supplying a high-frequency current of a predetermined fixed value from the exciting circuit as an energization means to the induction coil 6 of the coil assembly 3 to execute measurement of a curie temperature characteristic (Curie temperature) by a detection means for detecting the curie temperature characteristic of the fixation roller 1 and judgement processing (sequence) for judging suitability of the fixation roller (Seq 1). This judgment processing (Seq 1) is described below in detail. When the judgement processing is completed, the control portion 104 stops the power supply to the fixing apparatus 114 (S202). The basic flow of the processing in the Curie temperature measuring mode is as described above.

Next, the judgement processing (Seq 1) will be explained in detail with reference to FIGS. 6 and 7.

As shown in FIG. 6, first of all, a judgement as to whether or not a time (Time 1) required for the judgement is elapsed is made (Step S300).

The time (Time 1) is, similarly as in the case of performing the ordinary image forming operation, set so that it is longer, to some extent, than an ordinary time required from the start of supply of the high-frequency current from the exciting circuit 116 to the induction coil 6 of the coil assembly 3 to an increase in surface temperature of the fixation roller 1 from an environmental temperature to a target fixation temperature (substantially equal to the set Curie temperature).

Further, into the control portion 104, temperature progression information of the fixation roller 1 is inputted from the thermistor 11 continuously over time (in time series). The control portion 104 is a discrimination (judgement) means for discriminating (judging) whether or not the curie temperature characteristic (temperature rise characteristic) of the fixation roller 1 is within a desired characteristic range and judges whether or not the slope of the temperature rise curve of the fixation roller 1 becomes smaller than a predetermined slope at the time until the above described time (Time 1) is elapsed, on the basis of the fixation roller temperature progression information (S301). In this step, confirmation is made as to whether or not the temperature rise of the fixation roller 1 is converged at the time until the time (Time 1) described above is elapsed. In other words, whether or not the fixation roller temperature reaches the Curie temperature is checked. More specifically, temperature information inputted from the thermistor is read at certain intervals to obtain a temperature rise rate from a difference in temperature information between the read data. At that time, a discrimination as to whether or not the temperature rise rate is not more than a predetermined value is made by the discrimination means. In this embodiment, the temperature rise rate is determined from the difference in temperature information between the read data but may be determined from the progression of an average of some sampled values (in a predetermined time period).

In a step S302, when the discrimination means judges that the fixation roller temperature reaches the Curie temperature in the step S301, a discrimination as to whether or not the surface temperature (TEMP) of the fixation roller 1 measured by the thermistor 11 at the time when the time (Time 1) is elapsed (hereinafter, this temperature is referred to as an "actually measured Curie temperature (point)") is higher than the preliminarily set first temperature (Temp 1). The first temperature (Temp 1) is set at a temperature at which there is a possibility that the peripheral parts of the fixation roller go out of order, produce smoke, or catch fine.

When the discrimination means judges that the fixation roller temperature does not reach the Curie temperature in the step S301, the sequence is returned to the step S300 in which the similar processing is performed.

When the discrimination means judges that the surface temperature (TEMP) (actually measured Curie temperature) of the fixation roller 1 is lower than the preliminarily set first temperature (Temp 1) in the step S301, the discrimination means judges whether or not the surface temperature (TEMP) is lower than a preliminarily set second temperature (Temp 2) (step S303). The second temperature has been set at a lowest temperature at which an image fixability can be satisfied.

In the step S303, when the discrimination means judges the surface temperature (TEMP) of the fixation roller 1 is higher than the preliminarily set second temperature (Temp 2), the fixation roller 1 which is attached to the fixation roller 114 and has the curie temperature characteristic is in the temperature tolerance acceptable range in design (of the set Curie temperature), so that it is possible to judge that the fixation roller can satisfy a fixability of an image on the recording material or the transfer material as the recording medium without causing troubles to the peripheral equipment or the fixing apparatus 114 itself. In other words, the fixation roller 1 is judged that it is a fixation roller having a temperature rise characteristic similar to those P1 and P2 (dotted lines) shown in FIG. 7.

Figure 4:
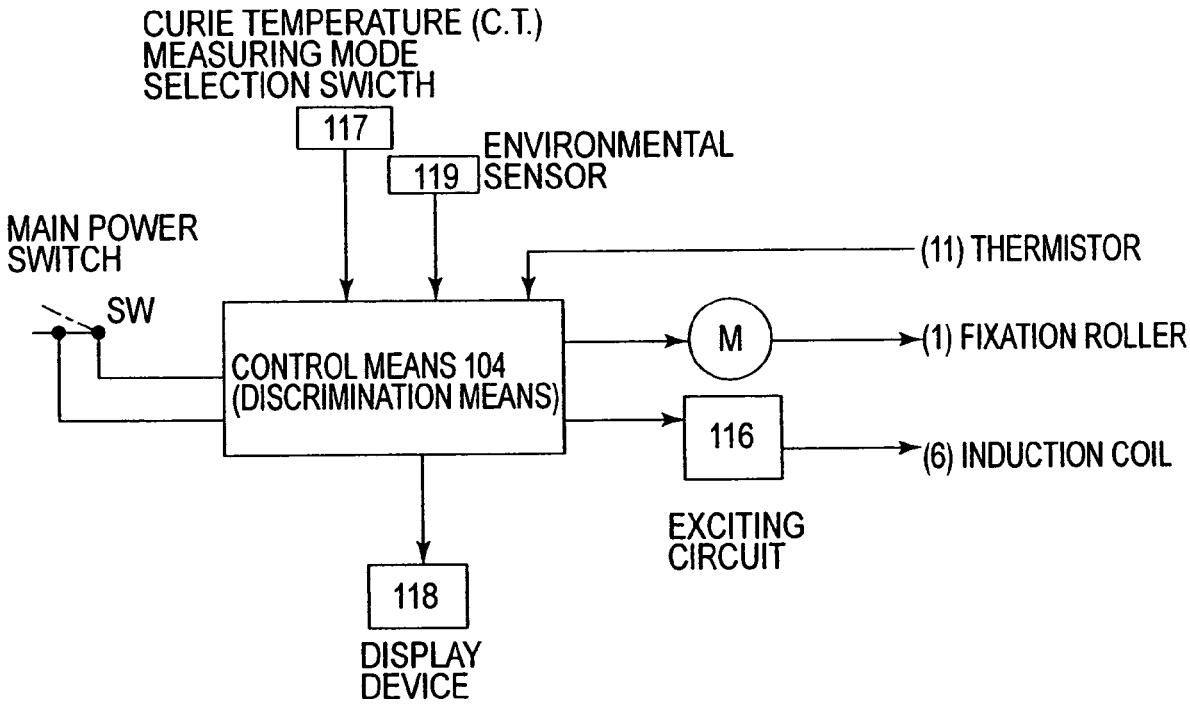
FIG. 4 is a block diagram of a control system.

Further, in the step S302, when the surface temperature (TEMP) of the fixation roller 1 is higher than the preliminarily set first temperature (Temp 1), it is possible to judge that the actual Curie temperature of the fixation roller 1 is higher than an upper limit of the temperature tolerance acceptable range of the set Curie temperature (target fixing temperature). More specifically, as shown in FIG. 7, in the case where if the fixation roller 1 mounted in the fixing apparatus 114 is placed in an out-of-control state, it is possible to judge that it is a fixation roller having a temperature rise characteristic similar to such a temperature rise characteristic P3 (solid line) shown in FIG. 7 that there is a possibility that peripheral parts go out of order, produce smoke, or catch fire even when the temperature rise is converged by the curie temperature characteristic. In this case, the control portion 104 as a control means for controlling whether energization of the magnetic flux generation means is continued or not terminates the supply of current to the induction coil 6 to stop heat generation of the heat generation member 1 and the image forming apparatus is placed in an image forming operation prohibition state (copy prohibition state) (step S304) and a warning to that effect is displayed on the display device 118 (FIG. 4). Even when the image forming apparatus is not provided with a display portion, it is possible to provide a voice warning. Further, it is also possible to give a direction to a display portion of external equipment, such as a personal computer or the like, so as to display the warning to that effect by connecting the image forming apparatus to the external equipment.

In the step S303, when the surface temperature (TEMP) of the fixation roller 1 is judged to be lower than the preliminarily set second temperature (Temp 2), it is possible to judge that the actual Curie temperature of the fixation roller 1 is lower than a lower limit of the temperature tolerance acceptable range of the set Curie temperature (target fixing temperature). More specifically, as shown in FIG. 7, it is possible to judge that the fixation roller 1 mounted in the fixing apparatus 114 is a fixation roller having a lower Curie temperature than the ordinary set fixing temperature and a temperature rise characteristic similar to such a temperature rise characteristic P4 (solid line) that an image fixability cannot be satisfied. Also in this case, the control portion 104 terminates the supply of current to the induction coil 6 to stop heat generation of the fixation roller 1 and place the image forming apparatus in the image forming operation prohibition state (S304) to display a warning to that effect on the display device 118 (FIG. 4).

Also in the case where the control portion 104 judges that the time (Time 1) required for the judgement processing has elapsed before the surface temperature of the fixation roller 1 reaches the Curie temperature, the control portion 104 terminates the supply of current to the induction coil 6 to stop heat generation of the fixation roller 1 and place the image forming apparatus in the image forming operation prohibition state (S304) to display the warning to that effect on the display device 118 (FIG. 4). More specifically, as shown in FIG. 7, in the case where if the fixation roller 1 mounted in the fixing apparatus 114 is placed in an out-of-control state, it is possible to judge that it is a fixation roller having a temperature rise characteristic similar to such a temperature rise characteristic P5 shown in FIG. 7 that there is a possibility that peripheral parts go out of order, produce smoke, or catch fire when the surface temperature of the fixation roller 1 is continuously increased.

Accordingly, by executing the above described Curie temperature measuring mode at the times of factory shipment and setting of the image forming apparatus, and replacement of the fixing member, it is possible to judge whether or not the actual Curie temperature of the fixation roller 1, which is mounted in the fixing apparatus and has the curie temperature characteristic, is within the temperature tolerance acceptable range. When the actual Curie temperature is judged to be out of the temperature tolerance acceptable range, it is possible to prevent the occurrences of trouble due to an inappropriate set Curie temperature of the fixation roller and fixation failure by replacing the fixation roller 1 with a new one as the defective fixation roller 1.

Further, even after the image forming apparatus is set, the user can check the change in Curie temperature due to the continuous use or deterioration of the fixation roller 1 having the curie temperature characteristic by selecting the Curie temperature measuring mode to execute the Curie temperature measuring mode. By doing so, it is possible to judge that the actual Curie temperature is within the set Curie temperature tolerance acceptable range, irrespective of the continuous use or deterioration of the fixation roller 1. Further, when the actual Curie temperature is judged to be out of the temperature tolerance acceptable range, the image forming apparatus is placed in the image forming operation prohibition state and a warning to that effect is displayed on the display device 118, so that it is possible to prevent trouble due to the inappropriate set Curie temperature of the fixation roller 1 and fixation failure. In this case, the user calls a service person and the fixation roller 1 is replaced with new one by the service person.

In this embodiment, the image forming apparatus is provided with an environment sensor 119 (FIG. 4) for detecting room temperature and humidity and detected information is inputted into the control portion 104. The control portion 104 appropriately changes and controls the settings of the first temperature (Temp 1) or/and the second temperature (Temp 2) in the above described Curie temperature measuring mode in accordance with a correlation table or a correlation computing equation between the preliminarily stored data of environmental temperature and the first temperature (Temp 1) or/and the second temperature (Temp 2). For example, the control portion 104 changes a condition for discriminating the curie temperature characteristic (a condition for judging whether the roller temperature is converged) while taking into consideration that a temperature rise speed (rate) at lower temperatures becomes slower than that at higher temperatures. More specifically, in the case where the fixation roller temperature reaches the Curie temperature when the roller temperature rise speed is not more than a predetermined value, the predetermined value at lower temperatures is set to be smaller than that at higher temperatures. Further, at lower temperatures, it is also possible to set the first temperature (Temp 1) or/and the second temperature (Temp 2) while taking into consideration that the roller temperature conveyance temperature becomes lower.

As described above, in this embodiment, the temperature at which the fixation roller 1 is caused to generate heat through induction heating to converge the temperature thereof is regarded as the actually measured Curie temperature, and is compared with the set Curie temperature. By the comparison, when the actually measured Curie temperature is out of the certain temperature tolerance acceptable range, it is possible to detect an abnormality of the thermistor 11 or the fixation roller 1. The Curie temperature check timing may be any of the times of factory shipment, setting, replacement of the fixing member, power-on, return to stand-by state, lapse of a predetermined time, etc.

Incidentally, in this embodiment, on the basis of the direct detection result of the fixation roller temperature by the thermistor, the Curie temperature is judged whether it is in the predetermined range or not. However, in the present invention, e.g., it is also possible to judge whether the fixation roller Curie temperature is in the predetermined range or not on the basis of a directly or indirectly measured result of a change in permeability of the fixation roller.

Embodiment 2

Figure 8:
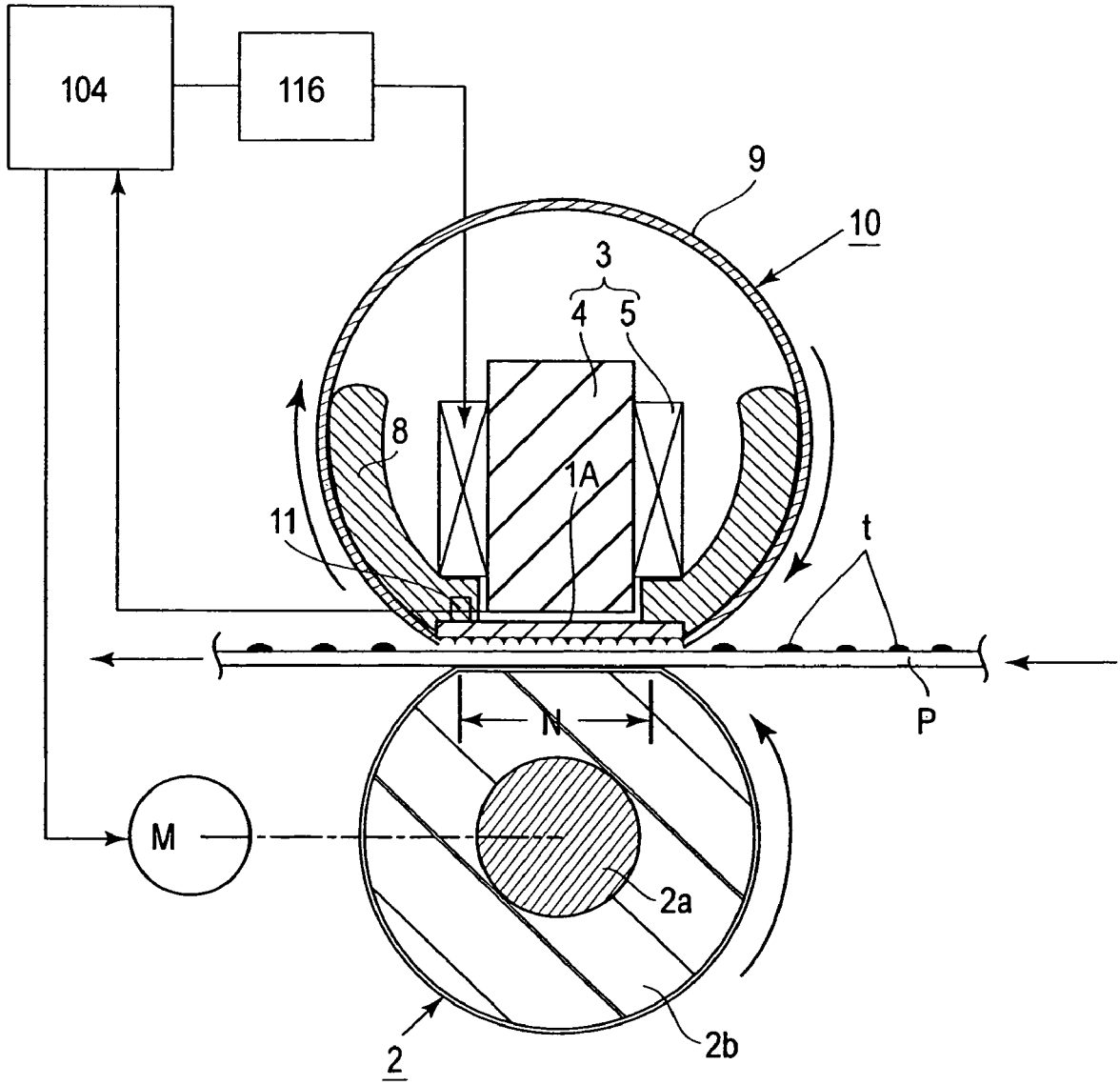
FIG. 8 is an enlarged cross-sectional view of a fixing apparatus in Embodiment 2.

FIG. 8 is a schematic structural view of an induction heating-type fixing apparatus in this embodiment. The fixing apparatus of this embodiment is a fixing apparatus of a film heating-type using a fixed induction heating member as a heater (heating member).

Referring to FIG. 8, a fixation film assembly 10 includes an elongated thin plate-like induction heat generation member 1A as a heater; a heater supporting member 8 which supports the heater 1A along a longitudinal direction at a lower surface thereof; a coil assembly 3 constituted by, e.g., a magnetic core 5 and a induction coil 6 which are disposed inside the heater supporting member 8; a cylindrical fixation film 9, formed of a heat-resistant resin, which is loosely engaged externally with an assembly of the heater 1A, the heater supporting member 8, and the coil assembly 3; a thermistor 11 is a temperature detection element for detecting a temperature of the heater 1A; and so on.

The fixing apparatus in this embodiment has a fixing temperature of 230° C., and the heater 1A as the induction heat generation member has such a curie temperature characteristic that a Curie temperature thereof is set to be substantially equal to the fixing temperature.

A pressure roller 2 as a pressure member is an elastic roller including a core shaft 2*a*, and a silicone rubber layer 2*b*, as a heat-resistant rubber layer with a surface releasability, which is integrally and concentrically wound around the core shaft 2. The pressure roller 2 is rotatably held between the side plates, located on the front and near sides of the fixing apparatus, each via a bearing at both end portions thereof.

On the upper side of the pressure roller 2, the above described fixing film assembly 10 is disposed in parallel with the pressure roller 2 with the heater 1A at the lower side thereof, and the heater supporting member 8 is provided with unshown urging means at both end portions thereof so that a pressing force by the urging means acts on the heater supporting member 8. As a result, the heater 1A at the lower surface of the heater supporting member 8 is pressed against the pressure roller 2 via the fixation film 9 while resisting elasticity, thus forming a fixing nip portion N having a predetermined width between the fixation film 9 and the pressure roller 2.

The pressure roller 2 is rotationally driven by a drive means M in a counterclockwise direction indicated by an arrow. By a frictional force, of the pressure roller 2 with the outer surface of the fixation film 9 in the fixing nip portion N, through the rotational drive of the pressure roller 2, a rotational force acts on the cylindrical fixation film 9. As a result, the inner surface of the fixation film 9 is rotated around the heater supporting member 8 in a clockwise direction indicated by an arrow while contacting and sliding the lower surface of the heater 1A in the fixing nip portion N (pressure roller driving scheme). The fixation film 9 is placed in such a rotation state that it has a peripheral speed substantially corresponding to a rotation peripheral speed of the pressure roller 2.

On the inner surface of the fixation film 9, fluorine-based grease is applied as a lubricant to ensure slidability of the fixation film 9 with the heater 1A and the heater supporting member 8.

The control portion 104 rotationally drives the pressure roller 2 by the drive source M at predetermined control timing and starts energization of a high-frequency current of a predetermined fixed value from the exciting circuit 116 to the induction coil 6 of the coil assembly 3 at predetermined timing, whereby a high-frequency alternating magnetic field is generated in the neighborhood of the induction coil 6 and the temperature of the heater 1A as the induction heat generation member is increased due to the electromagnetic induction heating of the heater 1A. The temperature of the heater 1A rises quickly and is converged at the Curie temperature, where the permeability of the heater 1A becomes 1, via the change point temperature of the permeability. Thereafter, the temperature of the heater 1A is substantially kept in a heating state at the Curie temperature so long as the above described high-frequency current energization to the induction coil 6 is continued (i.e., placed in a self-temperature controlled state).

The fixing apparatus in this embodiment has the fixation temperature of 230° C. and the heater 1A is the induction heat generation member having such a cure temperature characteristic that the Curie temperature thereof is substantially set to the fixation temperature as described above, so that the heating temperature of the heater 1A is substantially converged at 230° C. (fixation temperature) and the heater 1A is placed in the self-temperature controlled state. This temperature change with time of the heater 1A is detected by the thermistor 11, and detected temperature information is inputted into the controller 104. The controller 104 detects that the temperature of the heater 1A converges substantially at the Curie temperature.

Then, in the temperature-controlled state of the heater 1A, the recording material P, as a material to be heated, carrying thereon an unfixed toner image t is introduced from the image formation side into the fixing nip portion N. The recording material P is sandwiched and conveyed between the fixation roller 1 and the pressure roller 2 in the nip portion N, whereby the unfixed toner image t is heat-fixed on the surface of the recording material P under heat by the heater 1A via the fixation film 9 and pressure by pressing force at the nip portion N.

Similarly as in Embodiment 1, by providing the above described image forming apparatus including the fixing apparatus with the Curie temperature measuring mode, it is possible to judge whether or not the actual Curie temperature of the heater 1A, which is provided in the fixing apparatus as the induction heat generation member and has the curie temperature characteristic, is within the temperature tolerance acceptable range of the set Curie temperature. When the actual Curie temperature is out of the temperature tolerance acceptable range, the heater 1A is regarded as a defective heater and is replaced with new one. As a result, it is possible to prevent the occurrences of trouble due to an inappropriate set Curie temperature of the heater 1A and fixation failure.

(Miscellaneous)

1) The present invention is also applicable to an image forming apparatus including such an induction heating-type fixing apparatus that a temperature of an induction heat generation member is controlled by setting a fixation control temperature to be not more than a Curie temperature of the heat generation member. For example, in the fixing apparatus, the Curie temperature is set so that it is lower than a heat-resistant temperature of the fixing apparatus and is higher than the fixing temperature, whereby it becomes possible to alleviate or prevent a temperature rise in a differential area between a maximum-sized sheet passing area and a small-sized sheet passing area when the small-sized recording material is continuously passed through the nip portion. The present invention is also applicable to an image forming apparatus including an induction heating-type fixing apparatus provided with a magnetic flux shielding member for preventing a temperature rise in a non-sheet passing area and a drive means for driving the shielding member. As a result, it is possible to prevent the occurrences of trouble due to an inappropriate set Curie temperature of the induction heat generation member and fixation failure.

2) In the fixing apparatus of Embodiment 1, the coil assembly 3 as the magnetic flux generation means may also be disposed outside the fixation roller 1 as the induction heat generation member.

3) In the fixing apparatus of Embodiment 2, the fixation film 9 may also be rotationally driven by winding and extending it around a plurality of stretching members. Further, the fixation film 9 may be designed so that it is shaped in a long member which is rolled-up around a feeding axis and has an end which is moved toward a take-up axis.

4) The fixing apparatus according to the present invention is, other than the fixing apparatuses described in Embodiments 1 and 2, also applicable to an image heating apparatus for performing temporary fixation, such an image heating apparatus that an image carrying recording medium is re-heated to modify a surface characteristic such as floss or the like, and a heat treatment apparatus such that a material to be heated, other than the recording material, is conveyed to effect drying, heat lamination, removal of crease and curl by hot pressing, etc.

While the invention has been described with reference to the structures disclosed herein, it is not confined to the details set forth and t his application is intended to cover such modifications or changes as may come within the purpose of the improvements or the scope of the following claims.

This application claims priority from Japanese Patent Application No. 07/4042/2004 filed Mar. 16, 2004, which is hereby incorporated by reference.

What is claimed is:

1. An image heating apparatus comprising:

a coil for generating magnetic flux by energization;

an image heating member which generates heat by magnetic flux from said coil and heats an image on a recording material;

a temperature detection member for detecting a temperature of said image heating member;

energization control means for controlling energization of said coil;

discrimination means for discriminating whether or not a curie temperature characteristic is proper from a change in temperature rise on the basis of a detection result of said temperature detection member; and display means for displaying replacement of said image heating member on the basis of a result of discrimination of said discrimination means.

2. An apparatus according to claim 1, wherein execution of said discrimination means is terminated after a lapse of a predetermined period of time.

3. An apparatus according to claim 2, wherein said display means displays replacement of said image heating member when discrimination of the curie temperature characteristic cannot be completed in the predetermined period of time.

4. An apparatus according to claim 1, wherein the curie temperature characteristic is a temperature close to a curie temperature of said image heating member, and said discrimination means discriminates that the curie temperature characteristic is proper when the temperature is higher than an image heating temperature for heating the image on the recording material and lower than a heat-resistant temperature of said image heating apparatus.

5. An apparatus according to claim 1, wherein said image heating apparatus further comprises calculation means for calculating a temperature rise rate of said image heating member during execution of said discrimination means, and said display means displays replacement of said image heating member when the calculated temperature rise rate is larger than a first set value.

6. An apparatus according to claim 5, wherein said display means displays replacement of said image heating member when the calculated temperature rise rate is smaller than a second set value smaller than the first set value.

* * * * *

UNITED STATES PATENT AND TRADEMARK OFFICE

CERTIFICATE OF CORRECTION

PATENT NO. : 7,262,391 B2
APPLICATION NO. : 11/348356
DATED : August 28, 2007
INVENTOR(S) : Hiroto Nishihara et al.

It is certified that error appears in the above-identified patent and that said Letters Patent is hereby corrected as shown below:

COLUMN 1
Line 16, “curie” should read --Curie--.

COLUMN 2
Line 5, “As satisfying” should read --As--.

COLUMN 7
Line 3, “the both” should read --both--.

COLUMN 13
Line 42, “cure” should read --Curie--.

COLUMN 14
Line 54, “t his” should read --this--.

COLUMN 15
Line 6, “curie” should read --Curie--.
Line 17, “curie” should read --Curie--.
Line 19, “curie” should read --Curie--.
Line 20, “curie” should read --Curie--.

COLUMN 16
Line 2, “curie” should read --Curie--.

Signed and Sealed this

Seventeenth Day of February, 2009

John Doll

JOHN DOLL
*Acting Director of the United States Patent and Trademark Office*